US010603906B2

(12) United States Patent
Yasuda et al.

(10) Patent No.: US 10,603,906 B2
(45) Date of Patent: Mar. 31, 2020

(54) INK-JET PRINTING DEVICE AND INK-JET PRINTING METHOD

(71) Applicant: SCREEN HOLDINGS CO., LTD., Kyoto (JP)

(72) Inventors: Tomonori Yasuda, Kyoto (JP); Kiyoomi Mitsuki, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 15/998,497

(22) Filed: Aug. 16, 2018

(65) Prior Publication Data

US 2019/0054739 A1 Feb. 21, 2019

(30) Foreign Application Priority Data

Aug. 18, 2017 (JP) ..... 2017-157998

(51) Int. Cl.
*B41J 2/045* (2006.01)
*B41J 11/00* (2006.01)
*B41J 2/155* (2006.01)

(52) U.S. Cl.
CPC ..... *B41J 2/04573* (2013.01); *B41J 2/04503* (2013.01); *B41J 2/04556* (2013.01); *B41J 2/04586* (2013.01); *B41J 11/008* (2013.01); *B41J 2/155* (2013.01); *B41J 11/007* (2013.01); *B41J 2202/20* (2013.01)

(58) Field of Classification Search
CPC ..... B41J 2/04573
See application file for complete search history.

(56) References Cited

U.S. PATENT DOCUMENTS 6,296,403 B1 * 10/2001 Duchovne ..... B41J 3/28 400/23
6,334,720 B1 * 1/2002 Kato ..... B41J 19/145 400/118.2
6,695,426 B2 * 2/2004 Herwald ..... B41J 2/2132 347/19
9,010,893 B1 * 4/2015 Mizes ..... B41J 29/393 347/10
2007/0206040 A1 * 9/2007 Furuya ..... B41J 2/04573 347/15
2010/0238224 A1 * 9/2010 Kiyama ..... B41J 3/543 347/14

(Continued)

FOREIGN PATENT DOCUMENTS

JP 2006-096010 A 4/2006

*Primary Examiner* — Shelby L Fidler
(74) *Attorney, Agent, or Firm* — McDermott Will & Emery LLP

(57) ABSTRACT

An ink-jet printing device according to the present invention includes: first and second nozzles each configured to discharge ink droplets onto a recording medium being conveyed; a calculation unit to calculate a landing position difference on the recording medium being conveyed at a conveyance speed based on first and second conveyance speeds and first and second landing position differences; and a timing control unit to control each of timings of ink droplet discharge from the first and second nozzles based on the landing position difference calculated by the calculation unit. This configuration allows appropriate correction of variance in the landing positions of ink droplets discharged from the nozzles.

7 Claims, 8 Drawing Sheets

(56) References Cited

U.S. PATENT DOCUMENTS

2011/0074854 A1* 3/2011 Saettel ..... B41J 2/04503
347/16
2013/0025534 A1* 1/2013 Nakano ..... A61F 13/15577
118/300

* cited by examiner

| CONVEYANCE SPEED | CORRECTION PARAMETER |
|---|---|
| $V_{A1}$ | 1 |
| $V_{A2}$ | 2 |
| $V_{B1}$ | 1 |
| $V_{B2}$ | 3 |

INK-JET PRINTING DEVICE AND INK-JET PRINTING METHOD

BACKGROUND OF THE INVENTION

Field of the Invention

The present invention disclosed in the specification of the present application relates to an ink-jet printing device and an ink-jet printing method.

Description of the Background Art

In a conventional ink-jet printing device, when printing is performed on a recording medium (printing medium) being conveyed at a predetermined speed, variance in the landing position of ink droplets on the recording medium has been caused by, for example, a difference in the droplet speed of ink droplets discharged from nozzles.

To avoid this, a printing device disclosed in, for example, Japanese Patent Application Laid-Open No. 2006-96010 performs control to correct variance in the landing position of ink droplets.

However, when the conveyance speed of the recording medium changes, variance in the landing position of ink droplets changes with the speed change. Accordingly, the above-described method has difficulties in appropriately correcting the landing position of ink droplets.

SUMMARY

The present invention is directed to an ink-jet printing device.

An ink-jet printing device according to one aspect of the present invention includes: a first nozzle and a second nozzle each configured to discharge ink droplets onto a recording medium being conveyed; and a timing control unit to control each of timings of the ink droplet discharge from the first and second nozzles. Conveyance speeds at which the recording medium is conveyed include a first conveyance speed and a second conveyance speed different from the first conveyance speed. A landing position difference is a difference between a landing position of ink droplets discharged from the first nozzle on the recording medium and a landing position of ink droplets discharged from the second nozzle on the recording medium when the recording medium is conveyed at the conveyance speed. A first landing position difference is the landing position difference when the recording medium is conveyed at the first conveyance speed. A second landing position difference is the landing position difference when the recording medium is conveyed at the second conveyance speed. The ink-jet printing device further includes a calculation unit to calculate the landing position difference on the recording medium conveyed at the conveyance speed based on the first conveyance speed, the second conveyance speed, the first landing position difference, and the second landing position difference. The timing control unit controls the ink droplet discharge timings of the first and second nozzles based on the landing position difference calculated by the calculation unit.

It is possible to calculate, when the conveyance speed of the recording medium changes, a landing position difference in accordance with the changing conveyance speed by using two conveyance speeds different from each other and a landing position difference between a plurality of nozzles on the recording medium being conveyed at each of these conveyance speeds. Accordingly, variance in the landing positions of ink droplets discharged from the nozzles can be appropriately corrected at an optional conveyance speed by using the calculated landing position difference.

It is preferable that the first conveyance speed is a maximum speed at which the recording medium is conveyed, and the second conveyance speed is a minimum speed at which the recording medium is conveyed.

Accordingly, it is possible to improve the accuracy of calculation of a landing position difference of ink droplets on a recording medium conveyed at an optional conveyance speed.

It is preferable that the calculation unit calculates the landing position difference based on an equation $$P_V = \frac{P_1 - P_2}{V_1 - V_2} \times V$$

where $P_v$ represents the landing position difference, $P_1$ represents the first landing position difference, $P_2$ represents the second landing position difference, $V_1$ represents the first conveyance speed, $V_2$ represents the second conveyance speed, and V represents the conveyance speed.

It is possible to calculate a landing position difference when the recording medium is conveyed at a conveyance speed other than any conveyance speed stored in advance as long as the conveyance speed and the landing position difference are proportional to each other. Accordingly, an appropriate landing position difference can be calculated when the recording medium is conveyed at an optional conveyance speed.

It is preferable that the timing control unit synchronizes each of the ink droplet discharge timings of the first and second nozzles with a position signal periodically input and indicating the position of the recording medium in a conveyance direction, and the timing control unit specifies, based on the landing position difference calculated by the calculation unit, the position signal with which each of the ink droplet discharge timings of the first and second nozzles is synchronized.

It is possible to control each ink droplet discharge timing in synchronization with the periodically input position signal and shift, based on the calculated landing position difference, the position signal with which the synchronization is performed.

The present invention is also directed to an ink-jet printing method.

In an ink-jet printing method according to one aspect of the present invention, conveyance speeds at which the recording medium is conveyed include a first conveyance speed and a second conveyance speed different from the first conveyance speed, a landing position difference is a difference between a landing position of ink droplets discharged from the first nozzle on the recording medium and a landing position of ink droplets discharged from the second nozzle on the recording medium when the recording medium is conveyed at the conveyance speed, a first landing position difference is the landing position difference when the recording medium is conveyed at the first conveyance speed, and a second landing position difference is the landing position difference when the recording medium is conveyed at the second conveyance speed. The method includes: calculating the landing position difference on the recording medium conveyed at the conveyance speed based on the first conveyance speed, the second conveyance speed, the first landing position difference, and the second landing position difference; and controlling the ink droplet discharge timings of the first and second nozzles based on the calculated landing position difference.

It is possible to calculate, when the conveyance speed of the recording medium changes, a landing position difference in accordance with the changing conveyance speed by using two conveyance speeds different from each other and a landing position difference between a plurality of nozzles on the recording medium being conveyed at each of these conveyance speeds. Accordingly, variance in the landing positions of ink droplets discharged from the nozzles can be appropriately corrected at an optional conveyance speed by using the calculated landing position difference.

It is preferable that the first conveyance speed is a maximum speed at which the recording medium is conveyed, and the second conveyance speed is a minimum speed at which the recording medium is conveyed.

Accordingly, it is possible to improve the accuracy of calculation of a landing position difference of ink droplets on a recording medium conveyed at an optional conveyance speed.

It is preferable that the landing position difference is calculated based on an equation $$P_V = \frac{P_1 - P_2}{V_1 - V_2} \times V$$

where $P_v$ represents the landing position difference, $P_1$ represents the first landing position difference, $P_2$ represents the second landing position difference, $V_1$ represents the first conveyance speed, $V_2$ represents the second conveyance speed, and V represents the conveyance speed.

It is possible to calculate a landing position difference when the recording medium is conveyed at a conveyance speed other than any conveyance speed stored in advance as long as the conveyance speed and the landing position difference are proportional to each other. Accordingly, an appropriate landing position difference can be calculated when the recording medium is conveyed at an optional conveyance speed.

It is preferable that each of the ink droplet discharge timings of the first and second nozzles is synchronized with a position signal periodically input and indicating the position of the recording medium in a conveyance direction, and the position signal with which each of the ink droplet discharge timings of the first and second nozzles is synchronized is specified based on the calculated landing position difference.

It is possible to control each ink droplet discharge timing in synchronization with the periodically input position signal and shift, based on the calculated landing position difference, the position signal with which the synchronization is performed.

These and other objects, features, aspects and advantages of the present invention will become more apparent from the following detailed description of the present invention when taken in conjunction with the accompanying drawings.

DESCRIPTION OF THE PREFERRED EMBODIMENTS

A preferred embodiment of the present invention will be described below with reference to the accompanying drawings.

The drawings are schematically illustrated with omission or simplification of any component as appropriate for convenience of description. Mutual relations in size and position between components or the like illustrated in different drawings are not necessarily accurately illustrated but may be changed as appropriate.

In the following description, any identical component is denoted by an identical reference sign, and the name and function thereof are identical as well. Thus, any detailed description thereof will be omitted in some cases to avoid duplication.

In the following description, when terms such as "up", "down", "left", "right", "side", "bottom", "top", and "back" are used to mean particular positions and directions, these terms are used for sake of convenience to facilitate understanding of the contents of the preferred embodiment, and are not related to any direction when the invention is actually achieved.

In the following description, when ordinal numbers such as "first" and "second" are used, these terms are used for sake of convenience to facilitate understanding of the contents of the preferred embodiment, and the present invention is not limited to an order described with these terms.

<Preferred Embodiment>

The following describes an ink-jet printing device, an ink-jet printing method, and an ink-jet printing system according to the present preferred embodiment.

<Configuration of Ink-jet Printing System>

Figure 1:
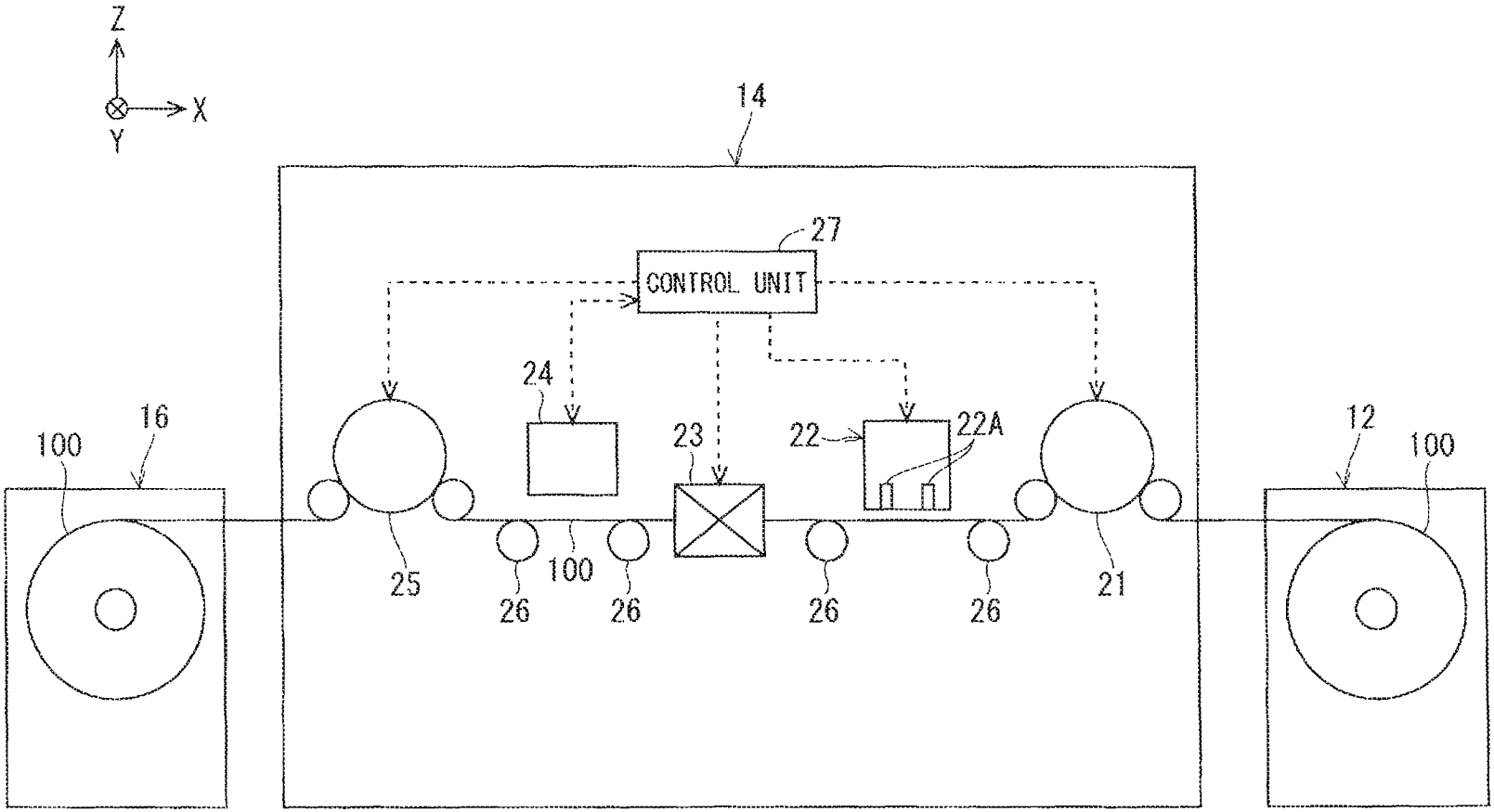
FIG. 1 is a diagram schematically and exemplarily illustrating the configuration of an ink-jet printing system according to a preferred embodiment.

FIG. 1 is a diagram schematically and exemplarily illustrating the configuration of the ink-jet printing system according to the present preferred embodiment. As exemplarily illustrated in FIG. 1, the ink-jet printing system according to the present preferred embodiment includes a feed unit 12, an ink-jet printing device 14, and a sheet ejection unit 16.

The feed unit 12 holds rolled continuous form paper 100 rotatably about a horizontal axis, and supplies the continuous form paper 100 to the ink-jet printing device 14 by winding. The ink-jet printing device 14 performs printing on the continuous form paper 100. The sheet discharge unit 16 winds, about the horizontal axis, the continuous form paper 100 printed at the ink-jet printing device 14.

When a side from which the continuous form paper 100 is supplied is defined to be upstream, and a side from which the continuous form paper 100 is discharged is defined to be downstream, the feed unit 12 is disposed upstream of the ink-jet printing device 14, and the sheet discharge unit 16 is disposed downstream of the ink-jet printing device 14.

The ink-jet printing device 14 includes, sequentially from the upstream side from which the continuous form paper is supplied, a drive roller 21, an ink-jet head 22, a drying unit 23, an examination unit 24, and a drive roller 25. The ink-jet printing device 14 includes, between these components, a plurality of conveyance rollers 26 supporting the continuous form paper 100 being conveyed.

The drive roller 21 acquires the continuous form paper 100 from the feed unit 12. The continuous form paper 100 being wound from the feed unit 12 by the drive roller 21 is conveyed toward the sheet discharge unit 16 on the downstream side along the plurality of conveyance rollers 26, in other words, a negative X-axis direction in FIG. 1.

The drive roller 25 feeds, toward the sheet discharge unit 16, the continuous form paper 100 being conveyed along the conveyance rollers 26.

The drying unit 23 dries ink printed by the ink-jet head 22. The examination unit 24 examines any contamination, printing miss, or the like in a printed region.

The ink-jet head 22 includes a plurality of nozzles 22A configured to discharge ink droplets. The configuration of the ink-jet head 22 will be described later in detail.

The ink-jet printing device 14 includes a control unit 27. The control unit 27 is achieved by a computer including, for example, a mouse, a keyboard, a monitor, and an external data inputting instrument, and specifically each correspond to a CPU and a transitory or non-transitory memory.

The control unit 27 controls printing operation on the continuous form paper 100 controlling operation of the drive roller 21, the ink-jet head 22, the drying unit 23, the examination unit 24, and the drive roller 25 based on input printing data.

Figure 2:
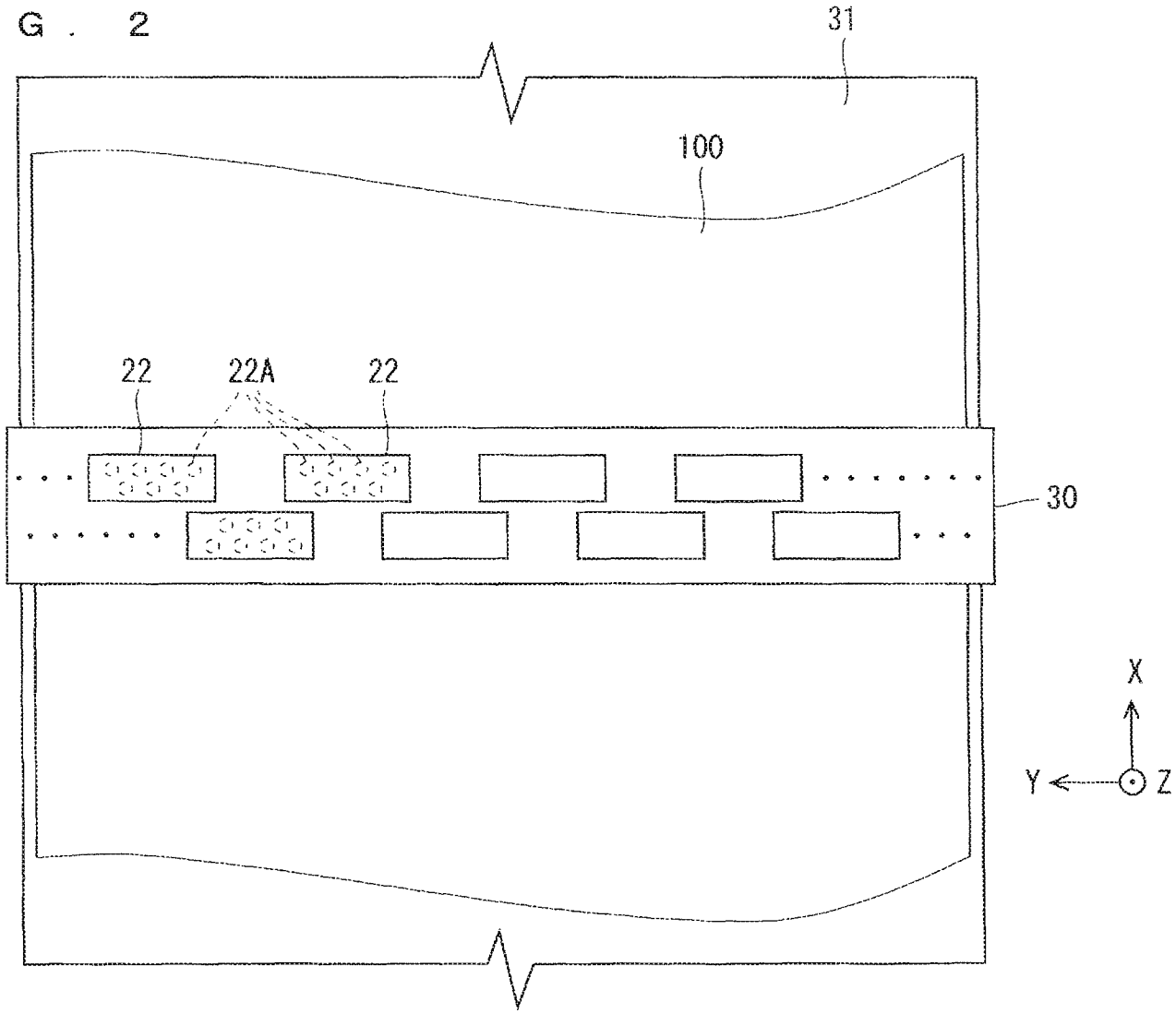
FIG. 2 is a plan view exemplarily illustrating the configuration of a line head including a plurality of ink-jet heads and the vicinity thereof.

FIG. 2 is a plan view exemplarily illustrating the configuration of a line head including a plurality of ink-jet heads and the vicinity thereof. In FIG. 2, a conveyance direction of the continuous form paper 100 is in the negative X-axis direction, and a printing direction is in a positive X-axis direction, which is opposite to the conveyance direction. As exemplarily illustrated in FIG. 2, this line head 30 includes an array of a plurality of ink-jet heads 22 each including the plurality of nozzles 22A. In the case exemplarily illustrated in FIG. 2, the ink-jet heads 22 are disposed in a zigzag manner at the line head 30, but are not limited to the disposition disclosed in FIG. 2.

A dielectric element (not illustrated) is attached to each nozzle 22A to discharge ink droplets in the nozzle 22A. The control unit 27 controls ink droplet discharge operation by controlling operation of the dielectric element at each nozzle 22A. The dielectric element is assumed to be, for example, a piezoelectric element.

As exemplarily illustrated in FIG. 2, each ink-jet head 22, and hence the line head 30 including the plurality of ink-jet heads 22 are disposed in a posture with a longitudinal direction thereof being aligned with a direction orthogonal to the conveyance direction of the continuous form paper 100, in other words, a Y-axis direction in FIG. 2. The line head 30 has a length equal to or longer than the width of a conveyance path 31 on which the continuous form paper 100 is conveyed, preferably, a length equal to the width of the conveyance path 31.

Typically, a plurality of line heads 30 are disposed in the conveyance direction (negative X-axis direction) of the continuous form paper 100. For example, one or two line heads 30 may be provided for each of black (K), cyan (C), magenta (M), and yellow (Y).

Figure 3:
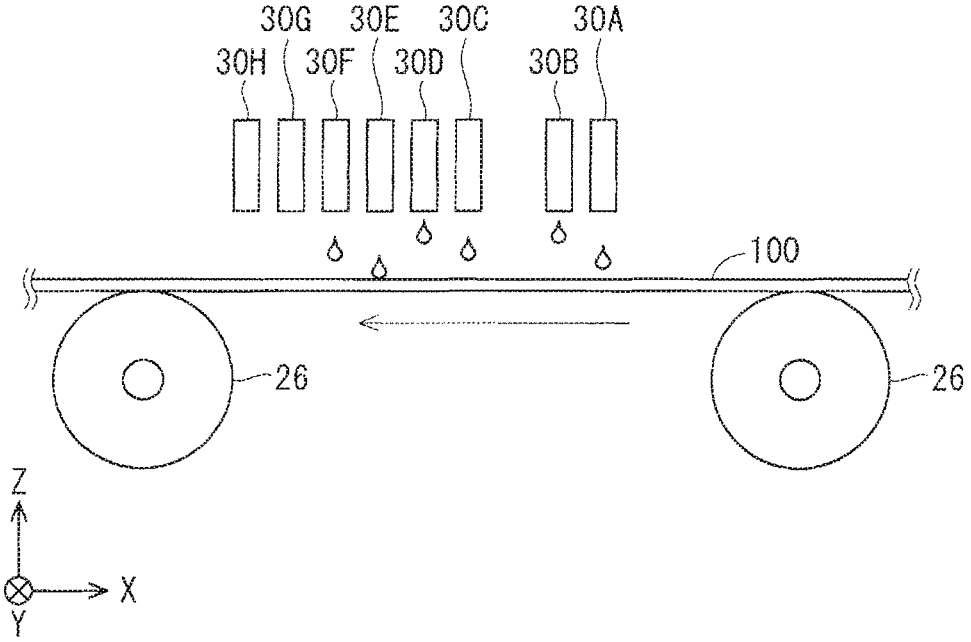
FIG. 3 is a diagram exemplarily illustrating, when two line heads are provided for each of black (K), cyan (C), magenta (M), and yellow (Y), the positional relation between the line heads and continuous form paper.

FIG. 3 is a diagram exemplarily illustrating, when two line heads are provided for each of black (K), cyan (C), magenta (M), and yellow (Y), the positional relation among the line heads and the continuous form paper.

As exemplarily illustrated in FIG. 3, line heads 30A and 30B for black (K), line heads 30C and 30D for cyan (C), line heads 30E and 30F for magenta (M), and line heads 30G and 30H for yellow (Y) are disposed side by side sequentially from the upstream side in the conveyance direction of the continuous form paper 100. However, the arrangement orders and corresponding colors of the line heads are not limited to the illustrated example.

In the case exemplarily illustrated in FIG. 3, two line heads are provided for each color. The line heads 30A, 30C, 30E, and 30G are referred to as front-row heads, the line heads 30B, 30D, 30F, and 30H are referred to as back-row heads.

Figure 4:
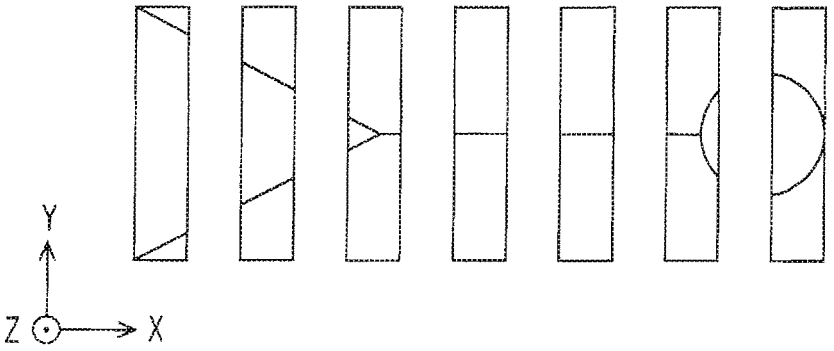
FIG. 4 is a diagram exemplarily illustrating a print image obtained by front-row heads.
Figure 5:
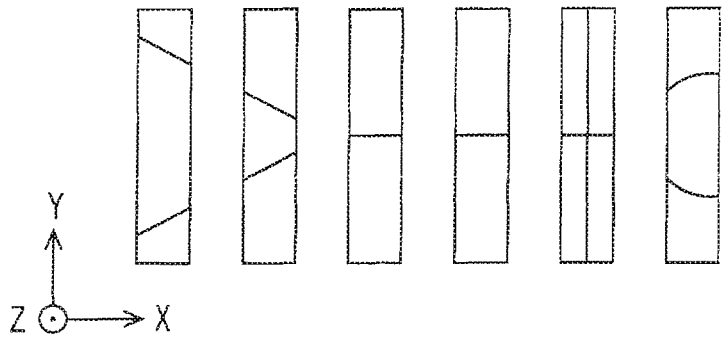
FIG. 5 is a diagram exemplarily illustrating a print image obtained by back-row heads.
Figure 6:
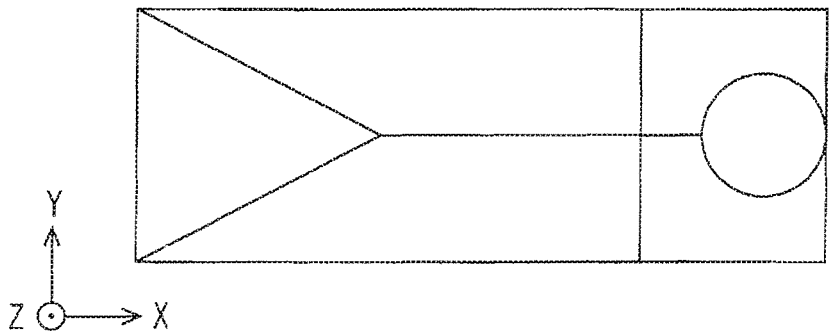
FIG. 6 is a diagram illustrating an image obtained by combining the print images obtained by the front-row and back-row heads.

In the present preferred embodiment, interlace printing is performed by using these line heads. FIG. 4 is a diagram exemplarily illustrating a print image obtained by using the front-row heads. FIG. 5 is a diagram exemplarily illustrating a print image obtained by using the back-row heads. FIG. 6 is a diagram illustrating an image obtained by combining the print image obtained by using the front-row heads and the print image obtained by the back-row heads.

The print image exemplarily illustrated in FIG. 4 is printed by the front-row heads, in other words, the line heads 30A, 30C, 30E, and 30G. The print image exemplarily illustrated in FIG. 5 is printed by the back-row heads, in other words, the line heads 30B, 30D, 30F, and 30H.

When appropriately disposed on the continuous form paper 100, the print image obtained by the front-row heads and the print image obtained by the back-row heads interpolate each other, thereby obtaining one print image as exemplarily illustrated in FIG. 6.

A timing at which ink droplets are discharged from the nozzles 22A of the front-row heads and a timing at which ink droplets are discharged from the nozzles 22A of the back-row heads need to be appropriately controlled so that the print image obtained by the back-row heads is appropriately disposed relative to the position of the print image obtained by the front-row heads on the continuous form paper 100. The control of the timing of ink droplet discharge from the nozzles 22A by the control unit 27 will be described later.

Figures 7, 8:
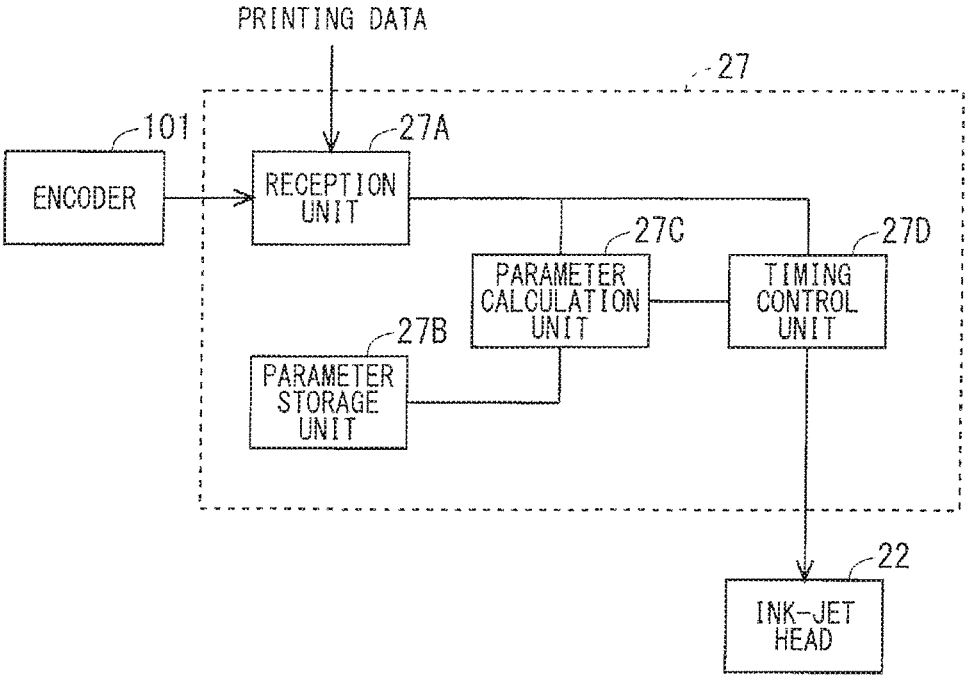
FIG. 7 is a diagram conceptually and exemplarily illustrating a functional configuration of a control unit exemplarily illustrated in FIG. 1, which is particularly related to control of an ink droplet discharge timing.
FIG. 8 is a diagram exemplarily illustrating a correction parameter (basic parameter) for each ink-jet head.

FIG. 7 is a diagram conceptually and exemplarily illustrating a functional configuration of the control unit exemplarily illustrated in FIG. 1, which is particularly related to the control of the ink droplet discharge timing. As exemplarily illustrated in FIG. 7, the control unit 27 includes a reception unit 27A, a parameter storage unit 27B, a parameter calculation unit 27C, and a timing control unit 27D.

The reception unit 27A receives printing data and an encoder signal from an encoder 101, and outputs a position signal. The position signal is a signal processed based on the encoder signal output from the encoder 101 disposed on the conveyance path 31 and a printing resolution. The position signal indicates a position in the conveyance direction of the continuous form paper 100, in other words, a position in the X-axis direction in FIG. 2, and corresponds to the ink droplet discharge timing. The encoder 101 is attached to, for example, the rotational axis of any of the rollers on the conveyance path 31.

The parameter storage unit 27B stores a plurality of conveyance speeds of each ink-jet head 22 and correction parameters, in other words, basic parameters at the plurality of conveyance speeds.

Each correction parameter has a value indicating how much the timing of ink droplet discharge from the corresponding ink-jet head 22 is shifted from the timing of ink droplet discharge from the ink-jet head 22 as a reference. Specifically, the value indicates how far the position signal synchronized at the timing of ink droplet discharge from the corresponding ink-jet head 22 is separated from the position signal synchronized at the timing of ink droplet discharge from the ink-jet head 22 as a reference. The value corresponds to the difference between the landing positions of ink droplets on the continuous form paper 100.

Although the present preferred embodiment describes an example in which the basic parameters are stored for each ink-jet head 22 having relatively significant variance in the landing positions of ink droplets, the ink droplet discharge timing can be controlled at higher accuracy by storing the conveyance speeds and the basic parameters for each nozzle 22A of the ink-jet head 22. The basic parameters are stored in advance before printing operation of the ink-jet printing device. However, while the ink-jet printing device repeatedly performs printing operation, an image of a printing region produced through the printing operation may be acquired by, for example, a scanner, and any basic parameter extracted based on the image may be updated and stored.

The parameter calculation unit 27C calculates a correction parameter at the conveyance speed of the continuous form paper 100 based on the basic parameters stored in the parameter storage unit 27B. The calculated correction parameter is referred to as a calculated parameter. The conveyance speed of the continuous form paper 100 can be calculated from the period of the position signal output from the reception unit 27A.

The timing control unit 27D controls the ink droplet discharge timing of the ink-jet head 22 based on the calculated parameter and the position signal.

FIG. 8 is a diagram exemplarily illustrating the correction parameter (basic parameter) for each ink-jet head. FIG. 8 exemplarily illustrates, for each ink-jet head, the conveyance speed of the continuous form paper 100 and the value of the correction parameter (basic parameter) at the conveyance speed. For example, $V_{A1}$ represents a first conveyance speed of an ink-jet head A, $V_{A2}$ represents a second conveyance speed of the ink-jet head A, $V_{B1}$ represents a first conveyance speed of another ink-jet head B, and $V_{B2}$ represents a second conveyance speed of the ink-jet head B.

In FIG. 8, each correction parameter has a positive value, but has a negative value depending on the discharge timing relation between the ink-jet head 22 as a reference and the corresponding ink-jet head 22.

<Operation of Ink-jet Printing System>

The following describes operation of the ink-jet printing system according to the present preferred embodiment with reference to FIGS. 9 to 13.

The description will be first made on control of the timing of ink droplet discharge from the nozzles 22A.

When one print image is produced by using the plurality of nozzles 22A as in the interlace printing in the present preferred embodiment, the timing of ink droplet discharge from each nozzle 22A needs to be appropriately controlled. For example, in the present preferred embodiment, when the timing of ink droplet discharge from the nozzles 22A is not appropriately controlled between the front-row and back-row heads, the landing position of discharged ink droplets on the continuous form paper 100 are shifted, and as a result, an appropriately coherent image cannot be printed as a whole. Specifically, the image includes an overlapping part, or separated parts, which leads to a printing miss.

The shift of the landing positions of discharged ink droplets on the continuous form paper 100 between the plurality of nozzles 22A is mainly caused by, for example, difference between the attachment positions of the nozzles 22A and difference between droplet speeds at which ink droplets are discharged from the nozzles 22A. In particular, the droplet speed difference is likely to occur between the nozzles 22A formed at the ink-jet heads 22 different from each other.

Figure 9:
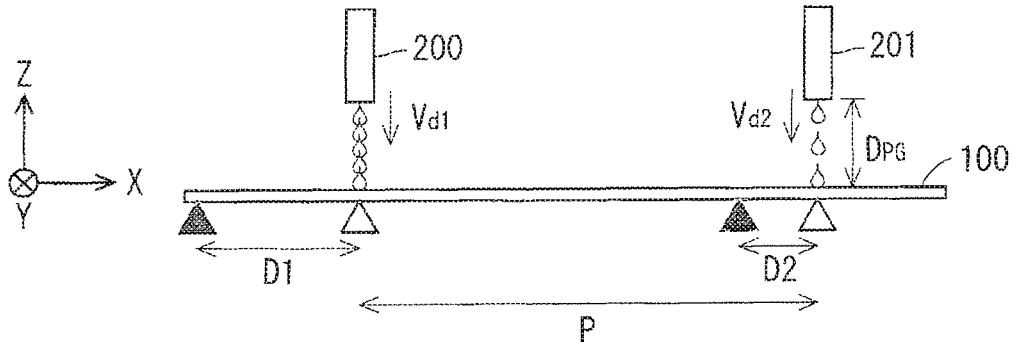
FIG. 9 is a diagram for description of landing positions of ink droplets discharged from a plurality of nozzles on continuous form paper.

FIG. 9 is a diagram for description of the landing positions of ink droplets discharged from a plurality of nozzles on the continuous form paper. In FIG. 9, $V_{d1}$ represents the droplet speed of ink droplets discharged from a nozzle 200, $V_{d2}$ (in this example, $V_{d1}<V_{d2}$) represents the droplet speed of ink droplets discharged from a nozzle 201, D1 represents the distance from a position directly below the nozzle 200 to the landing position of ink droplets, D2 represents the distance from a position directly below the nozzle 201 to the landing position of an ink droplets, $D_{PG}$ represents the distance from an edge of the nozzle 200 from which ink droplets are discharged to the continuous form paper 100, and P represents the distance between the nozzle 200 and the nozzle 201.

In this case, the shift of the landing positions of discharged ink droplets on the continuous form paper 100 between the plurality of nozzles 22A, in other words, the occurrence of a landing position difference between the plurality of nozzles 22A is mainly caused by difference between the attachment positions of the nozzles 22A (P in FIG. 9) and difference in a time until ink droplets discharged from the nozzles 22A land on the continuous form paper 100 (difference between D1 and D2 in FIG. 9).

The landing position difference ($\Delta_{D1D2}$) due to the difference between the droplet speeds of ink droplets discharged from the nozzles 22A can be expressed as Expression (1) below.

$$\Delta_{D1D2} = V_F \times \left(\frac{D_{PG}}{V_{d1}} - \frac{D_{PG}}{V_{d2}}\right) \tag{1}$$

In the expression, $\Delta_{D1D2}$ represents the difference between D1 and D2, and $V_F$ represents the conveyance speed of the continuous form paper 100. As expressed in Expression (1), the landing position difference ($\Delta_{D1D2}$) changes with the conveyance speed ($V_F$).

Figure 10:
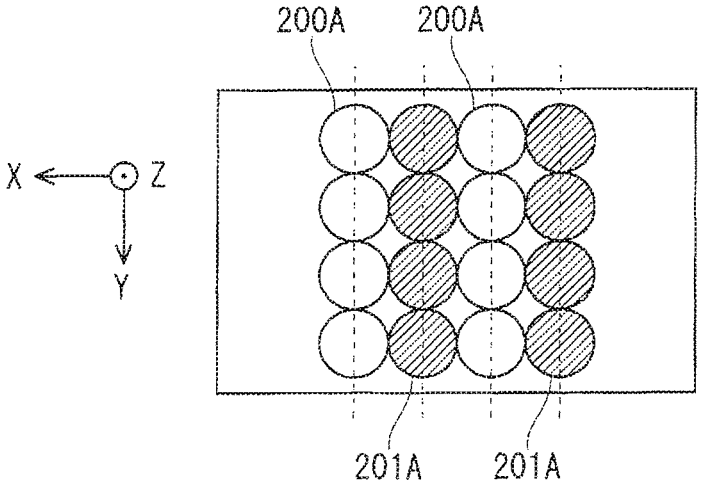
FIG. 10 is a diagram exemplarily illustrating the difference between landing positions at different conveyance speeds of continuous form paper.
Figure 11:
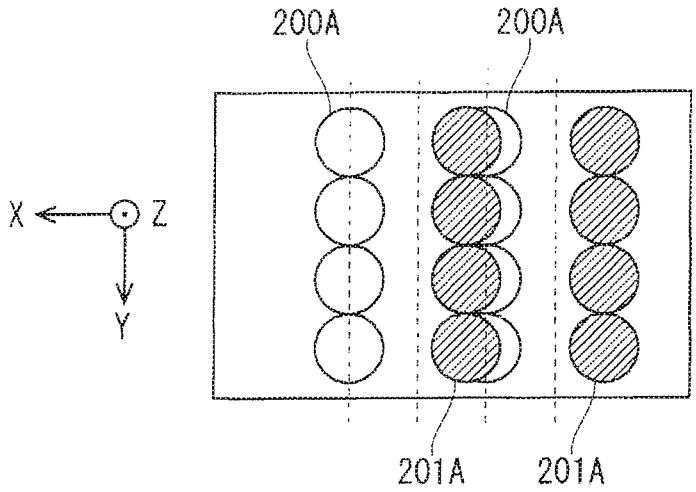
FIG. 11 is a diagram exemplarily illustrating the difference between landing positions at different conveyance speeds of continuous form paper.

FIGS. 10 and 11 are each a diagram exemplarily illustrating the landing position difference at different conveyance speeds of the continuous form paper. In FIGS. 10 and 11, the landing position difference is exemplarily illustrated for each ink-jet head having relatively significant variance in landing positions. Ink droplets discharged from one of the ink-jet heads do not land at correct positions as exemplarily illustrated in FIG. 11, for example, when the ink droplet discharge timing is controlled for the continuous form paper 100 being conveyed at a conveyance speed (120 mpm) and the same timing control is performed for the continuous form paper 100 being conveyed at another conveyance speed (15 mpm) as exemplarily illustrated in FIG. 10.

In FIG. 11, a landing position 201A of ink droplets discharged from a back-row head is shifted from an appropriate landing position illustrated with a dotted line, and as a result, is largely separated from a landing position 200A of ink droplets discharged from a front-row head. This causes partial overlapping between the landing position 200A and the landing position 201A.

Thus, a correction parameter $P_v$ is used to correct the landing position difference at an optional conveyance speed. The correction parameter $P_v$ is a calculated parameter obtained from correction parameters (basic parameters exemplarily illustrated in FIG. 8) at a plurality of conveyance speeds, and can be expressed as Expression (2) below.

$$P_V = \frac{P_1 - P_2}{V_1 - V_2} \times V \tag{2}$$

In the expression, $V_1$ and $V_2$ represent conveyance speeds different from each other, $P_1$ represents a correction parameter (basic parameter) when the conveyance speed is $V_1$, $P_2$ represents a correction parameter (basic parameter) when the conveyance speed is $V_2$, and V represents an optional conveyance speed.

Figure 12:
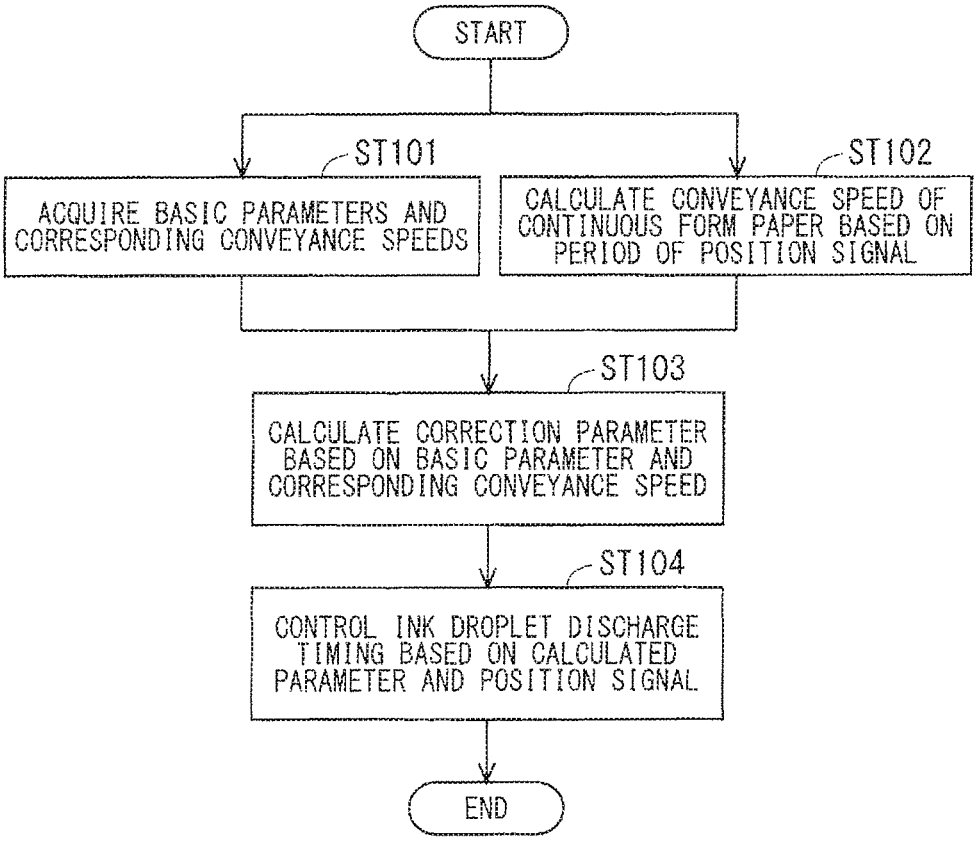
FIG. 12 is a flowchart exemplarily illustrating, operation of the ink-jet printing system, particularly, operation of controlling the ink droplet discharge timing.

The following describes printing operation on the continuous form paper 100 being conveyed at an optional conveyance speed by using the plurality of nozzles 22A. FIG. 12 is a flowchart exemplarily illustrating the operation of the ink-jet printing system, particularly, operation of controlling the ink droplet discharge timing.

First, the parameter calculation unit 27C of the control unit 27 recognizes the nozzles 22A that discharge ink droplets based on input printing data, and acquires the basic parameters of the nozzles 22A together with the corresponding conveyance speeds from the parameter storage unit 27B (refer to step ST101).

The basic parameters may be stored for a plurality of conveyance speeds for each nozzle 22A (in FIG. 8, each ink-jet head 22), but the plurality of conveyance speeds are desirably maximum and minimum speeds in a range in which printing is possible. This is because the accuracy of calculation of a correction parameter at an optional conveyance speed is improved.

The parameter calculation unit 27C of the control unit 27 calculates the conveyance speed V of the continuous form paper 100 based on the period of the position signal output from the reception unit 27A (refer to step ST102). Since the position signal is generated based on the encoder signal output from the encoder 101 provided to, for example, the rotational axis of any roller on the conveyance path 31 and the printing resolution, the period of the position signal varies with the conveyance speed of the continuous form paper 100.

Subsequently, the parameter calculation unit 27C of the control unit 27 calculates a correction parameter at a conveyance speed of the continuous form paper 100 based on the basic parameter and the corresponding conveyance speed (refer to step ST103). The correction parameter is calculated by using Expression (2) described above. The calculated correction parameter is referred to as a calculated parameter.

Subsequently, the timing control unit 27D of the control unit 27 controls the ink droplet discharge timing based on the calculated parameter and the position signal output from the reception unit 27A (refer to step ST104).

Figure 13:
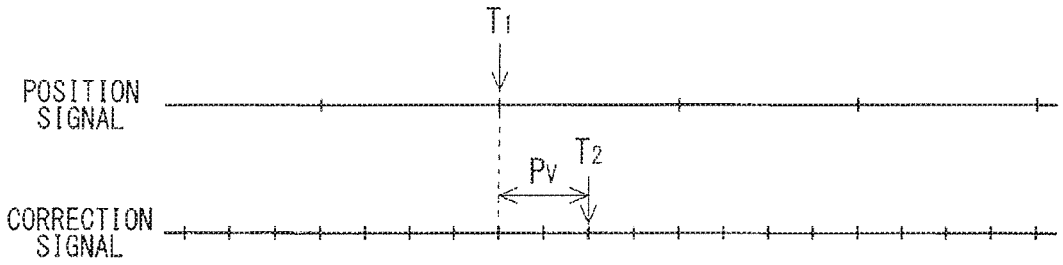
FIG. 13 is a diagram for specific description of timing control by a timing control unit.

FIG. 13 is a diagram for specific description of the timing control by the timing control unit. FIG. 13 illustrates position signals output periodically from the reception unit 27A and correction signals obtained in a period equal to, for example, a quarter of the period of the position signal.

In FIG. 13, when the ink droplet discharge timing as a reference is synchronized with the timing ($T_1$) of each position signal, the timing control unit 27D of the control unit 27 refers to the calculated parameter ($P_v$) to specify how much a correction signal, the timing of which is synchronized with the timing ($T_2$) of ink droplet discharge from target nozzles 22A is behind from (or ahead of) the position signal.

For example, when the discharge timing ($T_1$) as a reference is the timing of ink droplet discharge from the nozzles 22A of a front-row head, the timing control unit 27D of the control unit 27 synchronizes the timing ($T_2$) of ink droplet discharge from the nozzles 22A of a back-row head with a correction signal at a timing behind from (or ahead of) the discharge timing ($T_1$) as a reference by the calculated parameter ($P_v$).

When no correction signal is available at a position shifted by the calculated parameter ($P_v$), ink droplets can be discharged from the target nozzles 22A at a timing synchronized with a correction signal nearest to the position.

Although FIG. 13 illustrates the correction signal having a period equal to a quarter of the period of the position signal, it is possible to perform the timing control at higher accuracy by increasing the number of divisions.

The control unit 27 controls the printing operation on the continuous form paper 100 through the plurality of nozzles 22A by controlling operation of the drive roller 21, the drying unit 23, the examination unit 24, and the drive roller 25 in accordance with the timing of ink droplet discharge from the nozzles 22A.

<Effects of Above-described Preferred Embodiment>

The following exemplarily describes effects of the above-described preferred embodiment. In the following, the effects will be described based on a specific configuration exemplarily described above in the preferred embodiment, but the configuration may be replaced with any other specific configuration exemplarily described in the specification of the present application as long as the same effects are obtained.

According to the above-described preferred embodiment, an ink-jet printing device includes a first nozzle, a second nozzle, the timing control unit 27D, and a calculation unit. The first and second nozzles correspond to, for example, the nozzles 22A. The first nozzle may correspond to the nozzle 200, and the second nozzle may correspond to the nozzle 201. The calculation unit corresponds to, for example, the parameter calculation unit. The nozzles 200 and 201 discharge ink droplets onto a recording medium being conveyed. The recording medium corresponds to, for example, the continuous form paper 100. The timing control unit 27D controls the timings of ink droplet discharge from the nozzles 200 and 201. Conveyance speeds at which the continuous form paper 100 is conveyed include the first conveyance speed and the second conveyance speed different from the first conveyance speed. A landing position difference is the difference between the landing position of ink droplets discharged from the nozzle 200 on the continuous form paper 100 and the landing position of ink droplets discharged from the nozzle 201 on the continuous form paper 100 when the continuous form paper 100 is conveyed at an optional conveyance speed. The landing position difference corresponds to, for example, a correction parameter. A first landing position difference is the landing position difference when the continuous form paper 100 is conveyed at the first conveyance speed. The first landing position difference corresponds to, for example, a basic parameter. A second landing position difference is the landing position difference when the continuous form paper 100 is conveyed at the second conveyance speed. The second landing position difference corresponds to, for example, a basic parameter. The parameter calculation unit 27C calculates the landing position difference on the continuous form paper 100 being conveyed at an optional conveyance speed based on the first conveyance speed, the second conveyance speed, the first landing position difference, and the second landing position difference. The calculated landing position difference corresponds to, for example, a calculated parameter. Then, the timing control unit 27D controls each of the ink droplet discharge timings of the nozzles 200 and 201 based on the calculated parameter obtained by the parameter calculation unit 27C.

With this configuration, it is possible to calculate, when the conveyance speed of the continuous form paper 100 changes, a landing position difference (calculated parameter) in accordance with the changing conveyance speed by using two conveyance speeds different from each other and a landing position difference on the continuous form paper 100 being conveyed at each of these conveyance speeds between a plurality of nozzles. Accordingly, variance in the landing positions of ink droplets discharged from the nozzles can be appropriately corrected at an optional conveyance speed by using the calculated landing position difference (calculated parameter).

Since the variance in the landing positions of ink droplets at an optional conveyance speed can be appropriately corrected as described above, a printing miss or an overlapping printing region is unlikely to occur between front-row and back-row heads when interlace printing is performed.

In addition, it is possible to align the landing position of ink droplets at an optional conveyance speed when any ink-jet head 22 in a line head has a different landing position of ink droplets. In other words, it is possible to illustrate a desired straight line. It is also possible to align the landing position of ink droplets at an optional conveyance speed when the ink-jet heads 22 have different ink colors.

Any configuration exemplarily described in the specification of the present application other than these configurations may be omitted as appropriate. In other words, the above-described effects can be obtained by having at least these configurations.

However, the above-described effects can be obtained also when at least one of the other configurations exemplarily described in the specification of the present application is added to the above-described configurations as appropriate, in other words, when any other configuration exemplarily described in the specification of the present application but not described as the above-described configurations is added to the above-described configurations.

According to the above-described preferred embodiment, the first conveyance speed is a maximum speed at which the continuous form paper 100 is conveyed, and the second conveyance speed is a minimum speed at which the continuous form paper 100 is conveyed. With this configuration, it is possible to improve the accuracy of calculation of a calculated parameter for the continuous form paper 100 being conveyed at an optional conveyance speed.

According to the above-described preferred embodiment, the parameter calculation unit 27C calculates a calculated parameter based on an equation below.

$$P_V = \frac{P_1 - P_2}{V_1 - V_2} \times V$$

With this configuration, it is possible to calculate a calculated parameter when the continuous form paper 100 is conveyed at a conveyance speed other than any conveyance speed stored in advance as long as the conveyance speed and the basic parameter are proportional to each other. Accordingly, an appropriate calculated parameter can be calculated when the continuous form paper 100 is conveyed at an optional conveyance speed.

According to the above-described preferred embodiment, the timing control unit 27D synchronizes each of the ink droplet discharge timings of the nozzles 200 and 201 with a position signal periodically input and indicating the position of the continuous form paper 100 in the conveyance direction. Then, the timing control unit 27D specifies, based on the calculated parameter calculated by the parameter calculation unit 27C, the position signal with which each of the ink droplet discharge timings of the nozzles 200 and 201 is synchronized. With this configuration, it is possible to control each ink droplet discharge timing in synchronization with the periodically input position signal and shift, based on the calculated parameter, the position signal (correction signal) with which the synchronization is performed.

According to the above-described preferred embodiment, an ink-jet printing method obtains a calculated parameter for the continuous form paper 100 being conveyed at a conveyance speed based on the first conveyance speed, the second conveyance speed, the first landing position difference, and the second landing position difference. Then, each of the ink droplet discharge timings of the nozzles 200 and 201 is controlled based on the obtained calculated parameter.

With this configuration, it is possible to calculate, when the conveyance speed of the continuous form paper 100 changes, a landing position difference (calculated parameter) in accordance with the changing conveyance speed by using two conveyance speeds different from each other and a landing position difference between a plurality of nozzles corresponding to each speed. Accordingly, variance in the landing positions of ink droplets discharged from the nozzles can be appropriately corrected at an optional conveyance speed by using the calculated landing position difference (calculated parameter).

Any configuration exemplarily described in the specification of the present application other than these configurations may be omitted as appropriate. In other words, the above-described effects can be obtained by having at least these configurations.

However, the above-described effects can be obtained also when at least one of the other configurations exemplarily described in the specification of the present application is added to the above-described configurations as appropriate, in other words, when any other configuration exemplarily described in the specification of the present application but not described as the above-described configurations is added to the above-described configurations.

When not particularly restricted, the order of execution of processes may be changed.

<Modifications of Above-described Preferred Embodiment>

In the present preferred embodiment, a correction parameter at an optional conveyance speed is calculated as expressed in Expression (2) described above by assuming that the conveyance speed and the correction parameter are proportional to each other, but the present invention is applicable to a case with any relation other than the proportional relation.

In the present preferred embodiment, the continuous form paper 100 is described as an exemplary recording medium, but the technology disclosed in the present preferred embodiment is also applicable to any recording medium other than paper, such as a film. The technology is also applicable to any recording medium other than the continuous form paper 100, such as leaflets.

Although the present preferred embodiment exemplarily describes a case in which printing is performed on one of surfaces of a recording medium, in other words, a case in which one-side printing is performed, the technology disclosed in the present preferred embodiment is also applicable to a case in which duplex printing is performed.

In the present preferred embodiment, ink-jet printing is performed while the continuous form paper 100 is being conveyed relative to the ink-jet head 22. However, ink-jet printing may be performed while the continuous form paper 100 is temporarily stopped or while the ink-jet head 22 is moved relative to leaflets.

The materials, ingredients, dimensions, shapes, relative disposition relation, or conditions of components are described above in the preferred embodiment in some cases, but are merely exemplary in any aspect and not limited to those described in the specification of the present application.

Accordingly, numerous modifications and equivalents that are not exemplarily described are included in the scope of the technology disclosed in the specification of the present application. For example, modification of at least one component includes addition or omission.

Any optional component in the present preferred embodiment may be modified or omitted without departing from the scope of the present invention.

While the invention has been shown and described in detail, the foregoing description is in all aspects illustrative and not restrictive. It is therefore understood that numerous modifications and variations can be devised without departing from the scope of the invention.

What is claimed is:

1. An ink-jet printing device comprising:

a first nozzle and a second nozzle each configured to discharge ink droplets onto a recording medium being conveyed; and a timing control unit to control each of timings of the ink droplet discharge from said first and second nozzles, wherein conveyance speeds at which said recording medium is conveyed include a first conveyance speed and a second conveyance speed different from said first conveyance speed, a landing position difference is a difference between a landing position of ink droplets discharged from said first nozzle on said recording medium and a landing position of ink droplets discharged from said second nozzle on said recording medium when said recording medium is conveyed at said conveyance speed, a first landing position difference is said landing position difference when said recording medium is conveyed at said first conveyance speed, a second landing position difference is said landing position difference when said recording medium is conveyed at said second conveyance speed, the ink-jet printing device further comprises a calculation unit to calculate said landing position difference on said recording medium conveyed at said conveyance speed based on said first conveyance speed, said second conveyance speed, said first landing position difference, and said second landing position difference, and said timing control unit controls the ink droplet discharge timings of said first and second nozzles based on said landing position difference calculated by said calculation unit, wherein said timing control unit synchronizes each of the ink droplet discharge timings of said first and second nozzles with a position signal periodically input and indicating the position of said recording medium in a conveyance direction, and said timing control unit specifies, based on said landing position difference calculated by said calculation unit, said position signal with which each of the ink droplet discharge timings of said first and second nozzles is synchronized.

2. The ink-jet printing device according to claim 1, wherein said first conveyance speed is a maximum speed at which said recording medium is conveyed, and said second conveyance speed is a minimum speed at which said recording medium is conveyed.

3. The ink-jet printing device according to claim 1, wherein said calculation unit calculates said landing position difference based on an equation $$P_V = \frac{P_1 - P_2}{V_1 - V_2} \times V$$

where $P_v$ represents said landing position difference, $P_1$ represents said first landing position difference, $P_2$ represents said second landing position difference, $V_1$ represents said first conveyance speed, $V_2$ represents said second conveyance speed, and V represents said conveyance speed.

4. The ink-jet printing device according to claim 1, wherein when said timing control unit specifies said position signal with which the ink droplet discharge timings of said first and second nozzles is synchronized, said timing control unit specifies said position signal as said position signal with which the ink droplet discharge timings of said first and second nozzles is synchronized when said position signal coinciding with the discharge timings calculated based on said landing position difference exists, and said timing control unit specifies said position signal nearest to the discharge timings as said position signal with which the ink droplet discharge timings of said first and second nozzles is synchronized when said position signal coinciding with the discharge timings calculated based on said landing position difference does not exist.

5. An ink-jet printing method of controlling timings of ink droplet discharge from a first nozzle and a second nozzle each configured to discharge ink droplets onto a recording medium being conveyed, wherein conveyance speeds at which said recording medium is conveyed include a first conveyance speed and a second conveyance speed different from said first conveyance speed, a landing position difference is a difference between a landing position of ink droplets discharged from said first nozzle on said recording medium and a landing position of ink droplets discharged from said second nozzle on said recording medium when said recording medium is conveyed at said conveyance speed, a first landing position difference is said landing position difference when said recording medium is conveyed at said first conveyance speed, and a second landing position difference is said landing position difference when said recording medium is conveyed at said second conveyance speed, the method comprising:

calculating said landing position difference on said recording medium conveyed at said conveyance speed based on said first conveyance speed, said second conveyance speed, said first landing position difference, and said second landing position difference; and controlling the ink droplet discharge timings of said first and second nozzles based on said calculated landing position difference, wherein each of the ink droplet discharge timings of said first and second nozzles is synchronized with a position signal periodically input and indicating the position of said recording medium in a conveyance direction, and said position signal with which each of the ink droplet discharge timings of said first and second nozzles is synchronized is specified based on said calculated landing position difference.

6. The ink-jet printing method according to claim 5, wherein said first conveyance speed is a maximum speed at which said recording medium is conveyed, and said second conveyance speed is a minimum speed at which said recording medium is conveyed.

7. The ink-jet printing method according to claim 5, wherein said landing position difference is calculated based on an equation $$P_V = \frac{P_1 - P_2}{V_1 - V_2} \times V$$

where $P_v$ represents said landing position difference, $P_1$ represents said first landing position difference, $P_2$ represents said second landing position difference, $V_1$ represents said first conveyance speed, $V_2$ represents said second conveyance speed, and V represents said conveyance speed.

* * * * *